US006874557B2

(12) United States Patent
Jungklaus

(10) Patent No.: US 6,874,557 B2
(45) Date of Patent: Apr. 5, 2005

(54) ERGONOMIC AND EASILY SERVICEABLE TAPER TOOL

(75) Inventor: Matt Jungklaus, Lawrenceville, GA (US)

(73) Assignee: Axia, Inc., Houston, TX (US)

( * ) Notice: Subject to any disclaimer, the term of this patent is extended or adjusted under 35 U.S.C. 154(b) by 90 days.

(21) Appl. No.: 10/367,311

(22) Filed: Feb. 14, 2003

(65) Prior Publication Data

US 2004/0159406 A1 Aug. 19, 2004

(51) Int. Cl.[7] ..... B32B 31/00
(52) U.S. Cl. ..... 156/577; 156/579
(58) Field of Search ..... 156/71, 574, 575, 156/577, 579; 15/144.1, 144.3, 144.4

(56) References Cited

U.S. PATENT DOCUMENTS

| | | | | | |
|---|---|---|---|---|---|
| 577,220 | A | * | 2/1897 | Whitehead | 294/19.1 |
| 843,590 | A | * | 2/1907 | Dunn et al. | 15/144.4 |
| 2,300,398 | A | | 11/1942 | Ames | |
| 2,323,963 | A | | 7/1943 | Ames | |
| 2,502,499 | A | | 4/1950 | Ames | |
| 2,815,142 | A | | 12/1957 | Ames | |
| 3,260,638 | A | | 7/1966 | Hoveland | |
| 4,003,781 | A | * | 1/1977 | Holsten | 156/526 |
| 4,086,121 | A | | 4/1978 | Ames | |
| 4,090,914 | A | | 5/1978 | Hauk et al. | |
| 4,105,490 | A | | 8/1978 | Lass | |
| 4,466,152 | A | * | 8/1984 | Moss et al. | 15/229.2 |
| 4,828,647 | A | | 5/1989 | Eccleston | |
| 5,476,571 | A | | 12/1995 | Diaz | |
| 5,493,758 | A | * | 2/1996 | Carmien | 16/429 |
| 5,545,287 | A | | 8/1996 | Carlson | |
| 5,791,006 | A | * | 8/1998 | Anctil | 15/144.4 |
| 6,209,609 | B1 | * | 4/2001 | Edwards et al. | 156/577 |
| 6,294,034 | B1 | | 9/2001 | O'Mara et al. | |
| 6,513,562 | B1 | | 2/2003 | Trout | |
| 2003/0138569 | A1 | * | 7/2003 | Dillinger | 427/421 |

FOREIGN PATENT DOCUMENTS

| | | |
|---|---|---|
| GB | 800333 | 8/1958 |

* cited by examiner

*Primary Examiner*—Mark A. Osele
(74) *Attorney, Agent, or Firm*—Michael Best & Friedrich LLP

(57) ABSTRACT

The invention provides a taper tool, including a movable sleeve that has flanges with inclined surfaces for use as hand-holds. The sleeve rides on bearings, which are mounted in recesses out of the user's way. A spring-loaded wireform retainer secures the bearings in their respective recesses. The retainers include quick-change tabs that hold the retainers in a servicing position that permits the bearings to be easily removed and replaced. The taper tool also includes a spool mounting assembly having a guard rod that swings out and away from a tape spool for facilitating replenishment of the tape. When the guard rod is in the closed position, it is secured by a detent located on the tape spool spindle. The spool mounting assembly includes a base, a tape spool, a spindle, a guard rod and an end protector having rounded, grippable exterior edges.

33 Claims, 6 Drawing Sheets

ERGONOMIC AND EASILY SERVICEABLE TAPER TOOL

FIELD OF THE INVENTION

The invention relates to a taper tool for finishing a joint between adjacent panels, such as drywall sections or pieces of sheetrock. More specifically, the invention relates to improvements in the design and construction of taper tools.

BACKGROUND OF THE INVENTION

Wallboards are typically fastened side-by-side to create interior wall surfaces in modern buildings. Undesirable grooves appear along joints where adjacent wallboards meet.

In order to make the interior wall surfaces smooth and continuous, a mastic material is applied to fill the groove and tape is placed over the groove. Additionally, the outer side of the tape is often covered with another layer of mastic material to better conceal the tape. A tool known in the building trades as a "taper tool" is traditionally employed to perform some or all of these joint finishing operations.

A self-contained drywall taper tool of the type described in U.S. Pat. No. 4,086,121, issued to Ames, has been recognized as an industry standard for many years. While these and other previously known taper tools continue to be useful, they may still be improved. For example, even though the previously known taper tools are relatively light and well balanced, a full day of finishing joints is tiring for the user. In some cases, the areas where an operator is most likely to grip the previously known taper tools include abrupt protrusions and sharp edges that limit where the operator can place his hands. Also, such tools are commonly rented and receive a heavy volume of use, leading to substantial maintenance.

A need exists for a new taper tool that is easier to hold, manipulate and service. The butt end of the tool, including the end protector and any screws that secure it, should be comfortable for the operator to hold. A sleeve, which the operator manipulates to control the tool, should have generally smooth and gently contoured surfaces. Bearing mounts and fasteners should be located where they cannot interfere with the grip area of the sleeve or otherwise limit the placement of the operator's hands.

The new taper tool should also be easier to clean and repair than previously known taper tools. The number of components that must be individually removed in order to perform maintenance on the tool should be minimized. The number of small screws and other easy-to-lose parts should be reduced. The end protector and tape roll should be easy to remove and replace.

SUMMARY OF THE INVENTION

The invention provides a taper tool, including a movable sleeve that has flanges with inclined surfaces for use as hand-holds and rounded exterior edges. The sleeve rides on recessed bearings, which are mounted in recesses out of the user's way and which do not interfere with the operator's grip of the sleeve. Preferably, a spring-loaded retainer secures the bearings in their respective recesses. The retainers include quick-change tabs that hold the retainers in a servicing position that permits the bearings to be easily removed and replaced. At least one flange is removably mounted on and extends outwardly from the sleeve. The flange may be constructed in two half-circle shaped pieces and may be composed of a moldable polymer material The taper tool also includes a spool mounting assembly having a base and a tape spool, a spindle, a guard rod and an end protector, all mounted on the base so that the spool mounting assembly may be removed as a one-piece unit. The spool mounting assembly also includes a guard rod that swings out and away from a tape spool to facilitate replenishment of the tape. When the guard rod is in the closed position, it is secured by a detent located on the tape spool spindle.

The base of the spool mounting assembly is removably attached to the body, and all of the other spool mount assembly components are directly or indirectly attached to the base for efficient, one-piece removal and replacement. The spool mounting assembly also includes an end protector having rounded exterior edges that extends to the rear of the body during use. The end protector can be rotated from an unlocked position for removing the end protector from the base to a locked position for retaining the end protector on the base.

In one embodiment, the invention is a taper tool including a hollow elongated body, a tape feeder mounted on the body, and an elongated sleeve surrounding a portion of the body. The sleeve can be moved from a neutral position to a feeding position, which actuates the means for the tape feeder. The sleeve includes a front flange on the sleeve adjacent the forward sleeve end and a rear flange on the sleeve adjacent the rearward end. Each of the flanges includes at least one recess in which a bearing is mounted for moving the sleeve along the body. The front and rear flanges are suitably shaped to provide surfaces for the user's hand to push or pull against when moving the sleeve. The recessed bearing does not protrude from the grip area of the sleeve or otherwise limit the placement of the operator's hands.

In another embodiment, each of the bearings includes a roller and an axle, and each of the flanges includes at least one pair of pockets communicating with the recess for receiving the ends of the axles. A spring-loaded retainer secures each of the axles in their respective pockets. Additionally, the retainers include quick-change tabs that hold the retainers in a servicing position that permits the axles and the rollers to be removed and replaced.

The base can be aligned with and secured to the body within just a few seconds. The only alignment required is that the spool mount assembly be aligned rotationally with the tape-feeding wheels. Then, tightening one screw on each of two clamps secures the spool mount assembly to the body.

Each of the two clamps wraps around the body, attaches directly to the base, is held closed by the single screw. This greatly speeds servicing of the sleeve. Cable changes are also simplified in that the end protector detaches from the base without the use of any tools. After lifting a metal locking tab, which yields to finger pressure, the end protector can be twisted by hand and removed from the base. There are no small screws to lose when removing or replacing the end protector.

Changing rolls of paper tape is also faster and easier than with previously known taper tools. The roll retainer is a wireform rod, that is rotatably secured to the taper tool so that it will not be lost. The rod is unsnapped from a detent and rotated out of the way to permit access for the roll change. When the new roll is in position on the spindle, the rod is snapped back into place and held by the detent.

DETAILED DESCRIPTION OF PREFERRED EMBODIMENTS OF THE INVENTION

Figure 1:
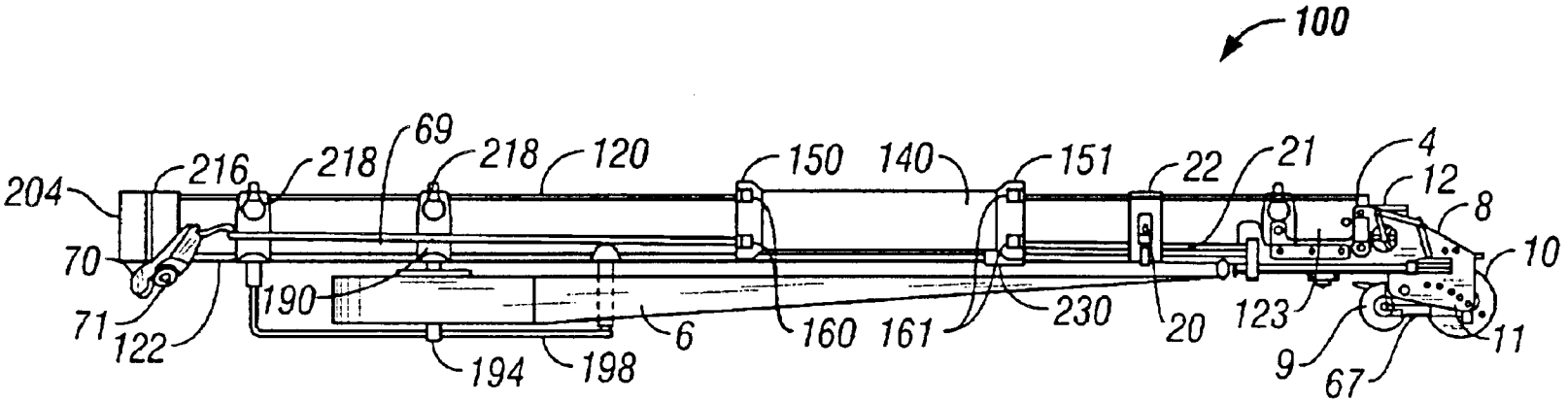
FIG. 1 is a side elevation view of a taper tool of the invention.

In a preferred embodiment, the invention is a taper tool such as taper tool 100, depicted in FIG. 1. Taper tool 100 shares some structure with the taper tool described in U.S. Pat. No. 4,086,121, which patent is hereby incorporated in its entirety for its teachings regarding taper tools and, specifically, for its teachings regarding feeding tape, delivering tape, applying mastic, creasing tape, cutting tape and the general design and operation of taper tools.

Figure 4:
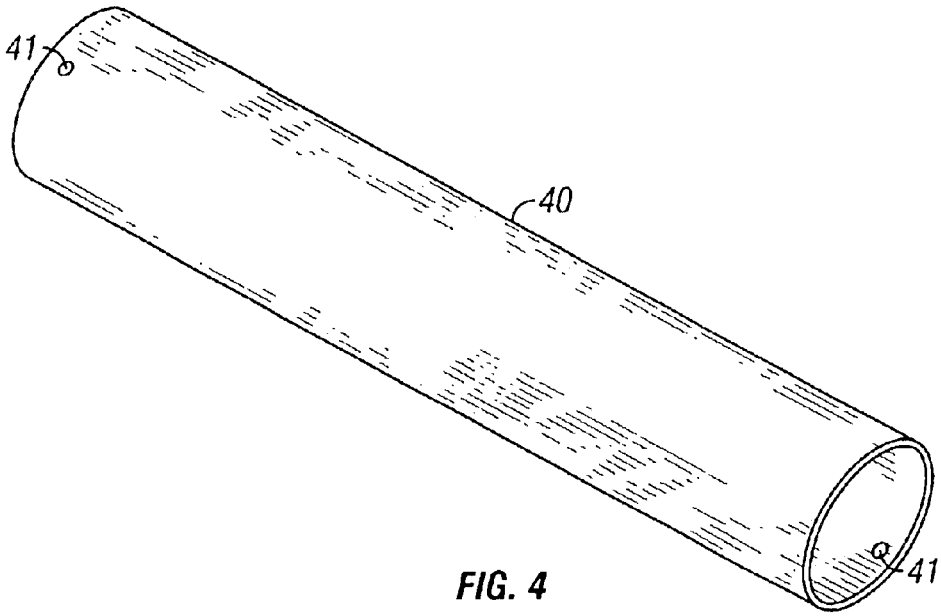
FIG. 4 is a perspective view of a sleeve of the invention.

Body 120 of tool 100 is shaped as a hollow cylinder for holding a supply of an adhesive or a sealant, hereinafter referred to as "mastic." Mastic may be of natural or synthetic origin, and is also know as "plastic" or "mud." Sleeve 140 is slidably mounted on body 120 for feeding tape 6 to forward end 123 of body 120 and for actuating a tape cutting knife (not shown). Sleeve 140 includes flanges 150, 151, recessed bearings 160, 161 and rod mount 230. Sleeve 140 is more fully described below with reference to FIG. 4.

Forward end 123 of body 120 is closed by removable front cap 4 (shown in FIG. 1), which includes a mastic filler tube (not shown) equipped with a spring-biased filler valve (not shown). When mastic is forced into the filler tube under pressure, the mastic opens the filler valve and enters the interior of body 120. When the filling operation is complete, the filler valve closes to prevent the mastic from escaping.

Front cap 4 has another opening (not shown) for leading mastic from the interior of body 120 into a mastic ejecting nozzle 8 for applying to tape 6. Wheels 10 receive tape 6 and hold it in sliding contact with an under surface of nozzle 8 so that the upper surface of tape 6 receives a layer of mastic from nozzle 8. Wheels 10 apply tape 6 with the mastic facing toward the wall surface (not shown). Wheels 10 are mounted on shaft 11, which is carried by extended side walls 67.

Figure 2:
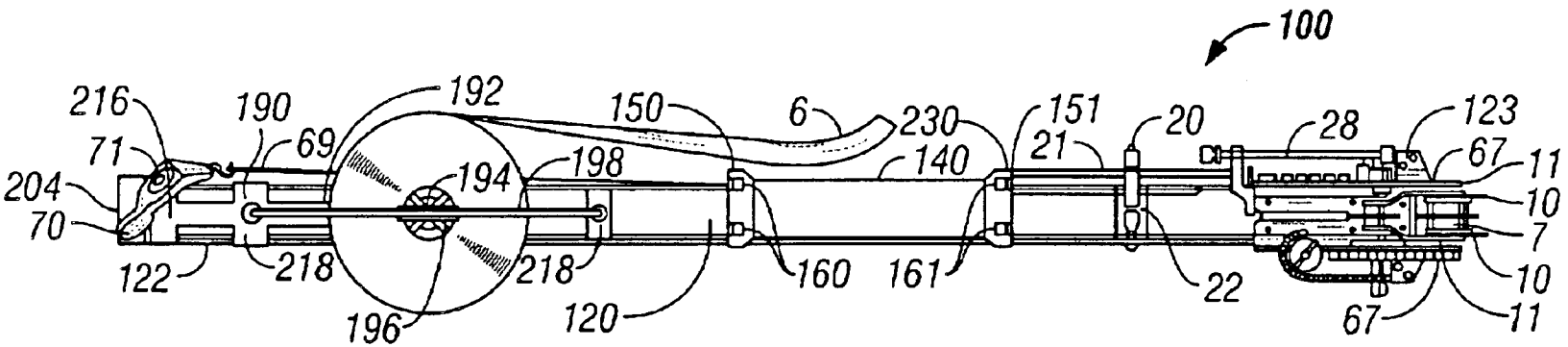
FIG. 2 is bottom elevation view of the tool depicted in FIG. 1.

Referring to FIG. 2, spool mounting assembly 190 is affixed to body 120 for, among other things, holding and feeding tape 6. Spool mounting assembly 190 includes base 192, spindle 194, spool 196, guard rod 198, trigger bracket 216 and end protector 204. A more complete description of spool mounting assembly 190 is set forth below with reference to FIG. 8.

Figure 3:
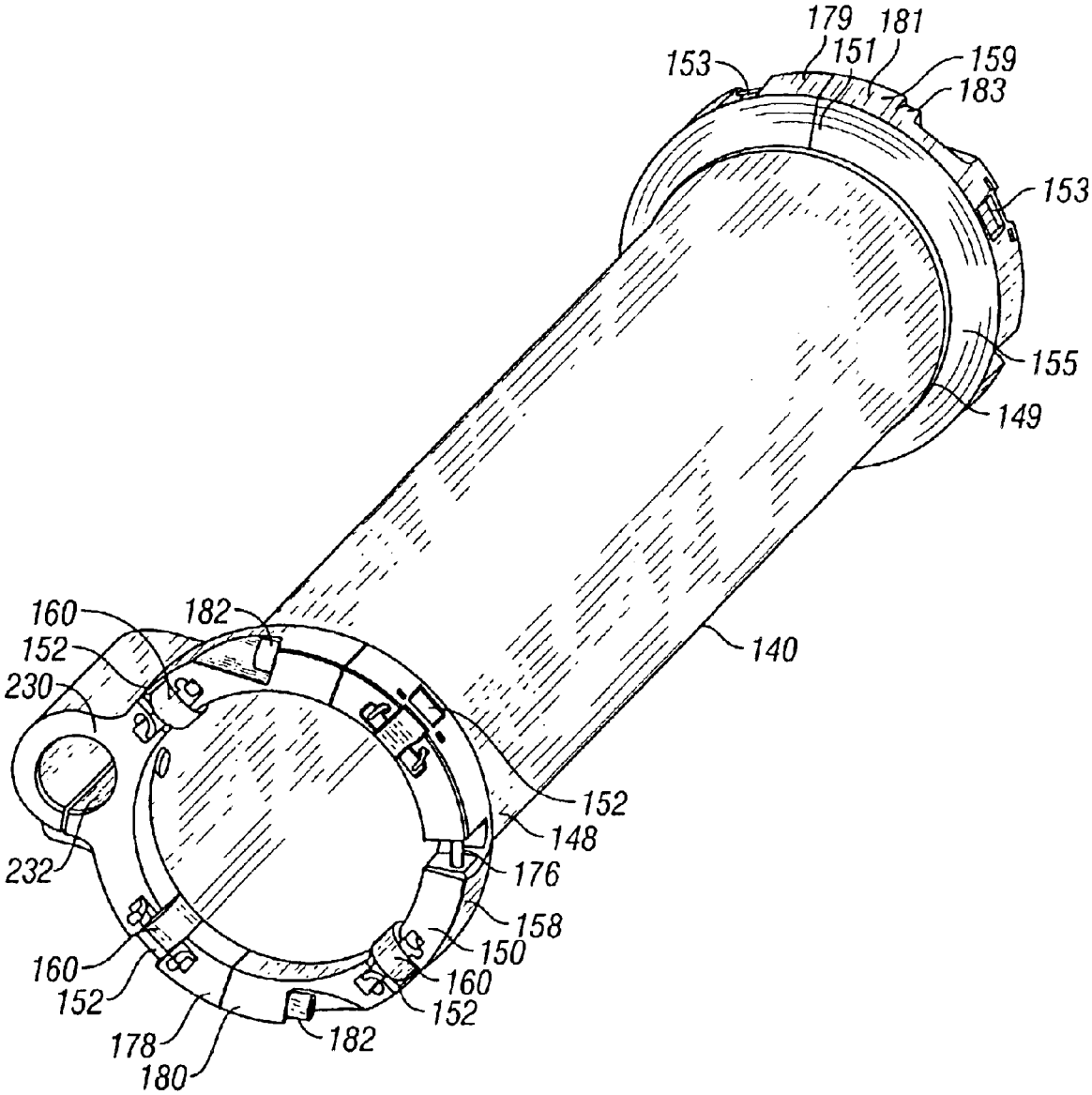
FIG. 3 is a perspective view of a sleeve assembly of the invention.

FIG. 3 provides a view of sleeve 140, which is manipulated by an operator for actuating two separate functions. Pulling sleeve 140 toward the rear end 122 of body 120 to a cutting position actuates a mechanical linkage including rod 21 and rod 28 (best seen in FIG. 2) that draws a knife (not shown) across and cuts tape 6. Pushing sleeve 140 toward the forward end 123 of body 120 to a feeding position feeds a tab of tape 6 into engagement with the rims of wheels 10 in preparation for beginning work on a new drywall joint (not shown). A neutral position for sleeve 140 lies between the cutting and feeding positions. An operator typically grasps sleeve 140 with one hand and places another hand around rear end 122 of tool 100.

As can be seen in FIG. 3, removable front flange 150 is mounted on forward end 148 of sleeve 140 and removable rear flange 151 is mounted on rearward end 149. Each of the flanges 150, 151 is shaped to provide a grip area having surfaces that the operator's hand may comfortably push or pull against when moving sleeve 140 from one position to another. For example, each of the flanges 150, 151 forms a generally smooth, inclined surface 154 (best seen in FIG. 5) or 155, respectively, that extends radially from the outer surface of sleeve 140. The grip area of sleeve 140 is substantially free of any protrusions or sharp edges that might otherwise limit the placement of the operator's hands. Additionally, all exterior corners or edges of the flanges 150, 151 are preferably rounded to provide a comfortable grip for the operator.

Continuing with FIG. 3, flanges 150 is equipped with an attachment device 176, such as a pin or ring, for attaching a lanyard. Lanyards are useful in situations that require the operator to extend the operator's reach with the tool 100 such as, for example, finishing a joint near a high ceiling.

FIG. 3 illustrates the manner in which bearings 160 are mounted in recesses 152 of flange 150. Bearings 161 (not shown) are mounted in recesses of flange 151. Sleeve 140 rides along body 120 on bearings 160, 161. Bearings 160, 161 are recessed beneath the outer surfaces 158, 159 of the front and rear flanges 150, 151, respectively. Consequently, outer surfaces 158, 159 are generally smooth and offer a convenient surface for the operator's hand to rest against when pulling or pushing sleeve 140.

Flanges 150, 151 are constructed as clamshells 178, 179, which are approximately in the shape of half circles that wrap around ends 148, 149 of sleeve 140. Preferably, flanges 150, 151 are composed of a moldable polymer material and equipped with small bosses on their interiors that register with corresponding registration holes 41 (shown in FIG. 4) located adjacent to ends 148, 149, thereby securing the flanges to the sleeve. This construction technique permits flanges 150, 151 and sleeve 140 to be manufactured without the use of special aluminum tube forming operations or special grades of aluminum.

Figure 5:
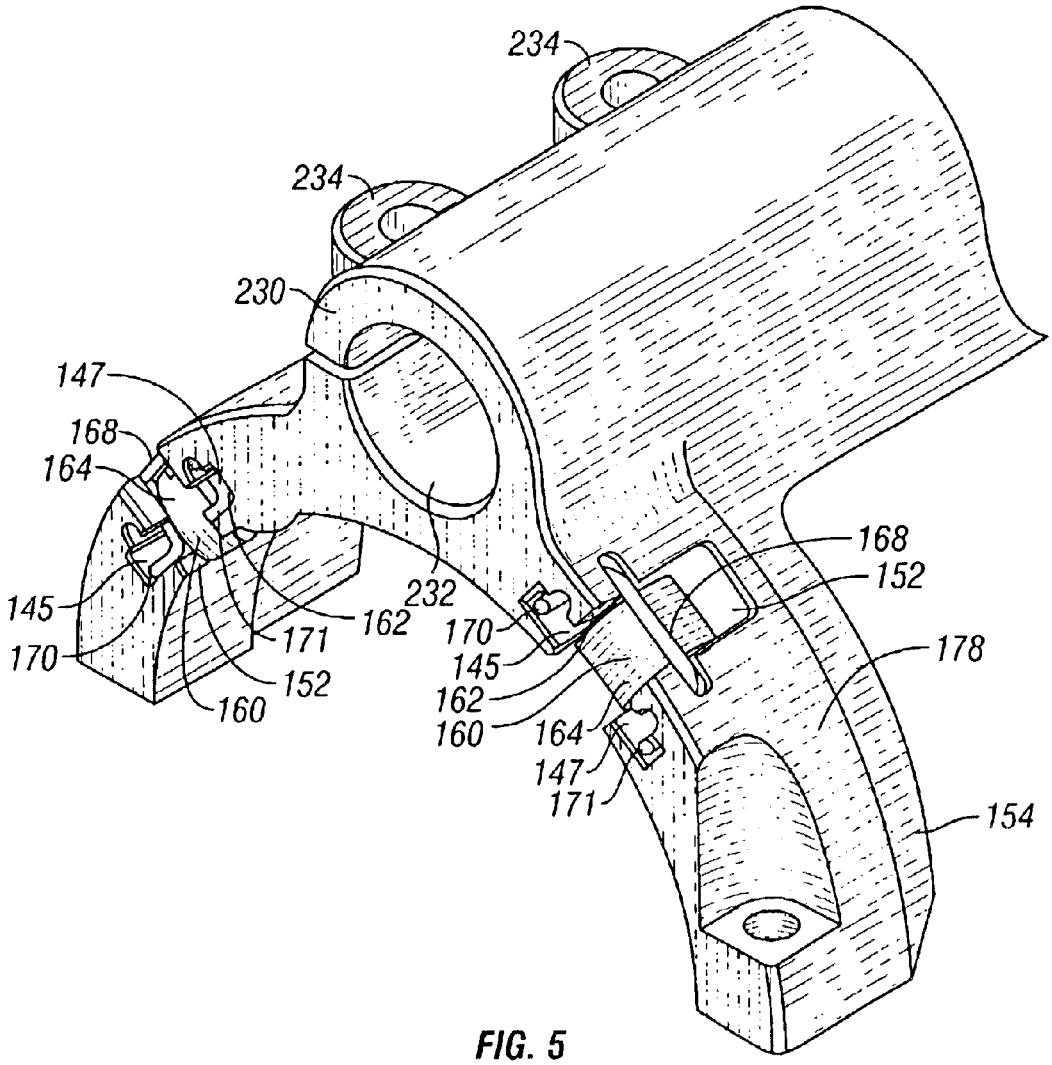
FIG. 5 is a perspective view of a clamshell-shaped portion of a flange of the invention.

Turning now to FIG. 5, it can be seen that each of the bearings 160 includes a roller 164 that turns about an axle 162. Each of the axles 162 (not shown) is mounted with its ends in a pair of pockets (145 or 147, respectively). Each pair of pockets 145, 147 communicates with one of the recesses 152, 153. A spring-loaded wireform retainer 168 is inserted into each of the recesses 152, 153 to prevent the axles 162, 163 (not shown) from leaving their respective pockets 145, 147.

Figure 6:
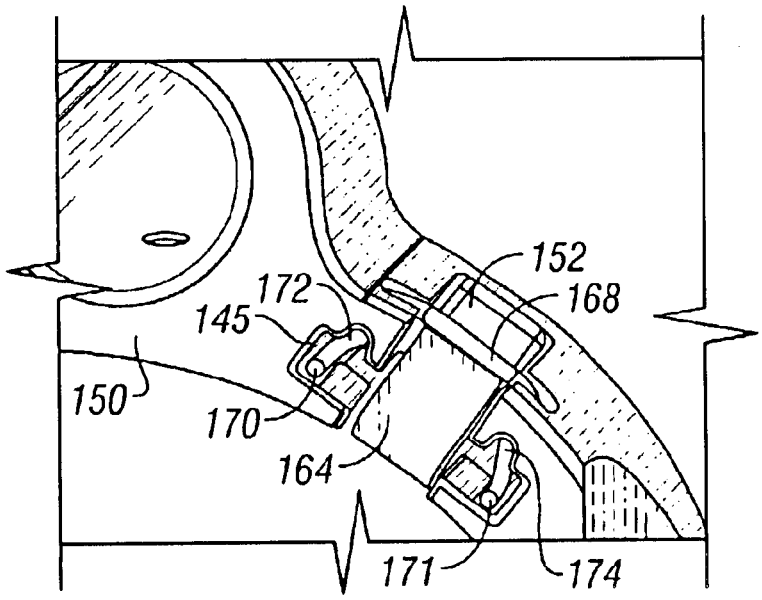
FIG. 6 is a close-up perspective view of a recessed bearing having a retainer in a retaining position.
Figure 7:
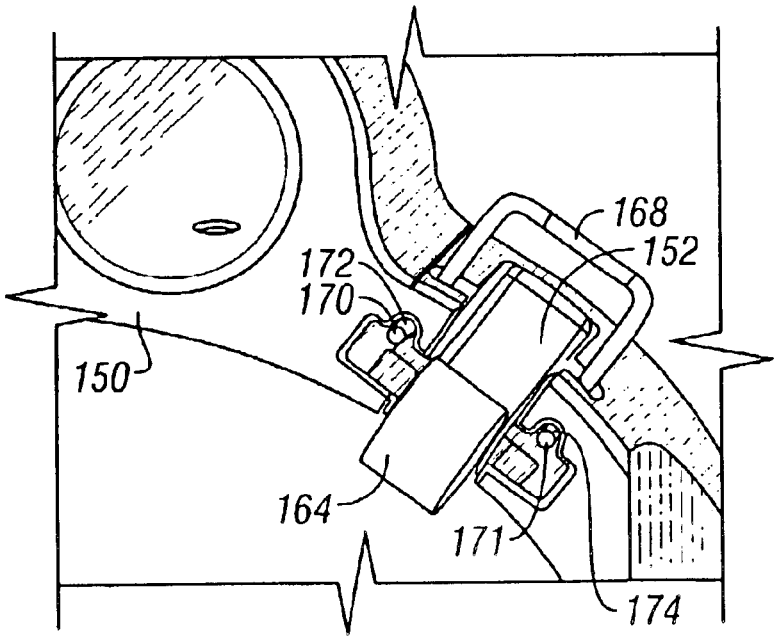
FIG. 7 is a close-up perspective view of a recessed bearing having a retainer in a servicing position.

Retainer 168 includes tabs 170, 171 for successively engaging pockets 145, 147 in one of two positions. In a retaining position, shown in FIG. 6, retainers 168 cannot move away from the axis of the respective flanges 150, 151, because the tabs 170, 171 are extended across the full width of pockets 145, 147 and sufficiently close to the axles and rollers to prevent them from leaving their pockets. In a servicing position, which is depicted in FIG. 7, retainers 168 are spaced further from the longitudinal axis of flanges 150, 151 and no longer to prevent the axles 162 (not shown) and rollers 164, 165 from leaving their respective pockets 145, 147. However, tabs 170, 171 are sufficiently engaged with notches 172, 174 located within pockets 145, 147 so as to prevent loss of retainers 168 during any servicing or replacement of the bearings 160, 161.

Retainers 168 may be moved to the servicing position by forcing spring-loaded tabs 170, 171 towards each other and prying retainer 168 outwardly by employing, for example, a screwdriver as a lever. While retainer 168 is in the servicing position, roller 164 may be removed from its recess 152 or 153 by prying the associated axle 162 (not shown) out of pockets 145, 147. For replacement, roller 164 is pushed back into recess 152, as the respective axle 162 or 163 (not shown) is pushed into its pockets 145, 147. Then, retainer 168 is returned to the retaining position as shown in FIG. 7, by pushing it inwardly and permitting retainer 168 to expand and engage across the full width of pockets 145, 147.

Figure 8:
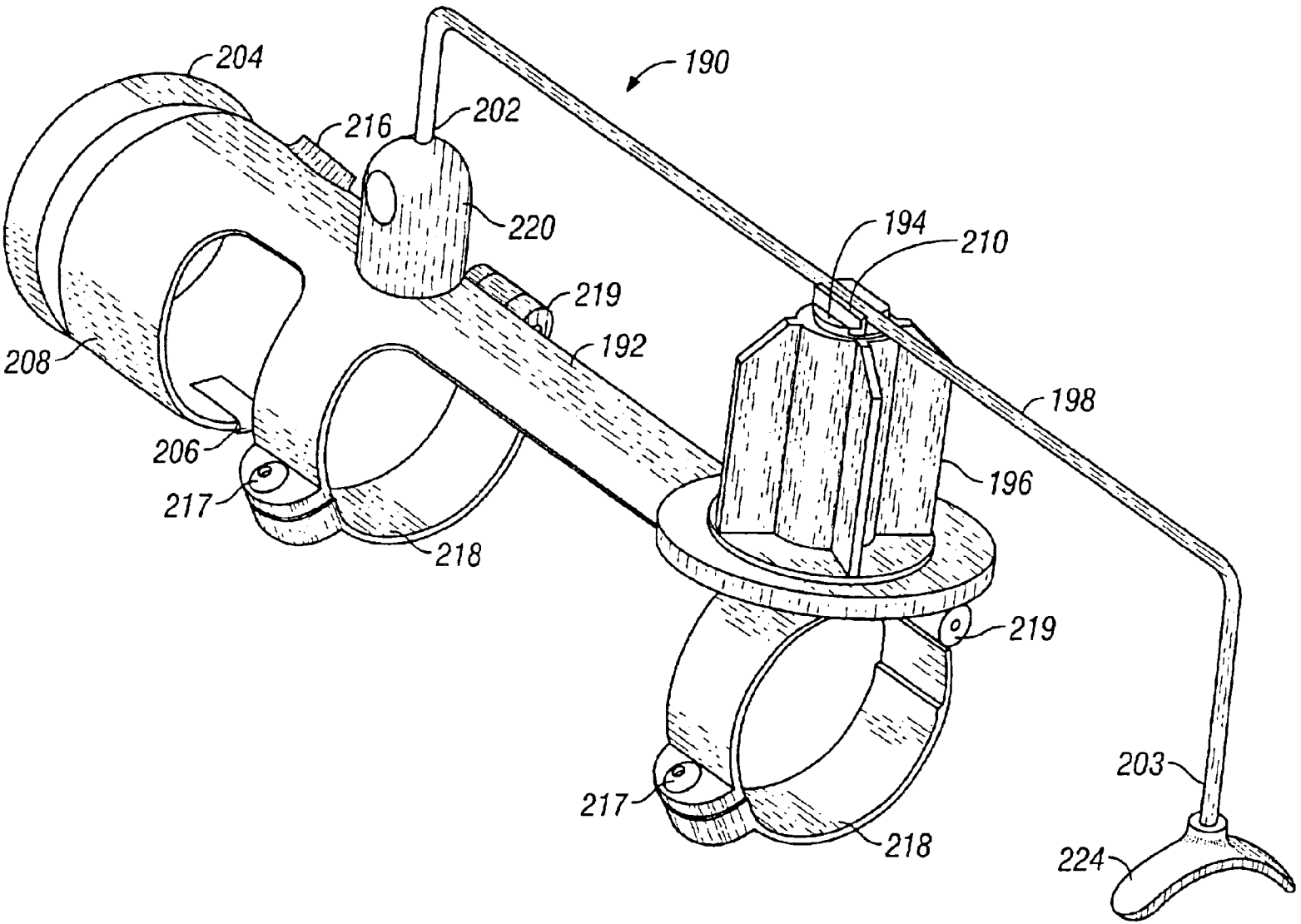
FIG. 8 is perspective view of a spool mount assembly of the invention.

FIG. 8 is a perspective view of spool mounting assembly 190, which includes base 192. As can be seen in FIG. 8, circular clamps 218 are attached to base 192 for the purpose of removably mounting spool assembly 190 on body 120, adjacent the rear end 122. Preferably, clamps 218 are attached to base 192 by hinges 219 that may be opened for placing spool mounting assembly 190 on body 120. Clamps 218 are held closed by, for example, screws 217.

Figure 9:
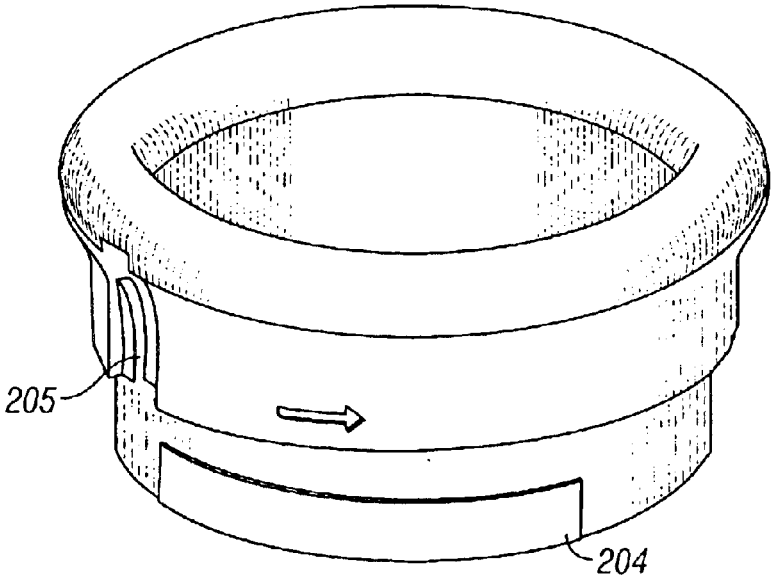
FIG. 9 is a perspective view of an end protector of the invention.
Figure 10:
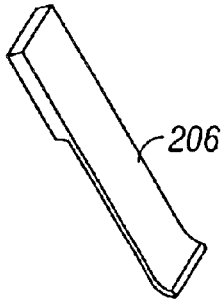
FIG. 10 is a perspective view of a clip of the invention.

End protector 204 is also attached to base 192 so that end protector 204 may fit around and project beyond rear end 122 of body 120. End protector 204 provides a comfortable handhold for the user and protects body 120 in the event of damage from bumps and shocks that occur when tool 100 is in use. As shown in FIG. 9, end protector 204 is shaped and sized to mate with base 192 and to lock in the mated position when rotated a quarter turn relative to base 192. Once end protector 204 is locked onto base 192, locking pin 206, depicted in FIG. 10, is slipped over guide ring 208 of base 192 and into groove 205 of end protector 204, for preventing inadvertent rotation and unlocking of end protector 204. Finger pressure is sufficient to release locking pin 206, and the end protector 204 can be rotated by hand. Consequently, no tools are required to mount or remove end protector 204.

Returning to FIG. 8, bracket 216 is provided on base 192 for mounting trigger 70 (best seen in FIG. 1), which is used to actuate tape creasing disc 9 via linkage 69. Pivoting bracket 220, also attached to base 192, rotatably secures guard rod 198 while permitting guard rod 198 to rotate about its end 202 relative to base 192. The other end 203 of guard rod 198 is fitted with a resilient stop member 224, which rests against and conforms to body 120 when the guard rod 198 is in a closed position. As shown in FIG. 8, guard rod 198 extends in the closed position completely across tape spool 196 and is captured by detent 210 located at a distal end of spindle 194. An upward tug on guard rod 198 is normally sufficient to dislodge detent 210 and permit guard rod 198 to rotate into an open position (not shown) for replacing tape spool 196 or tape 6.

Figure 11:
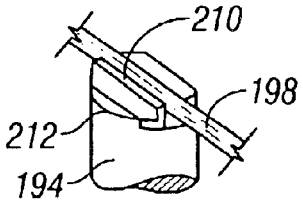
FIG. 11 is a close-up view of the detent mounted on the distal end of the spindle depicted in FIG. 8.

FIG. 11 is a close-up view of distal end 212 of spindle 194, showing the manner in which detent 210 captures guard rod 198. Preferably, detent 210 is composed of a resilient material, such as a plastic or a spring steel, so that an interference fit between guard rod 198 and a slot in detent 210 provides sufficient friction to hold guard rod 198 in the closed position while tool 100 is being used. Other types of detents can be used successively with or in place of detent 210 in the invention including, for example, a ball detent, a spring detent, a catch or a hook and eye.

Figure 12:
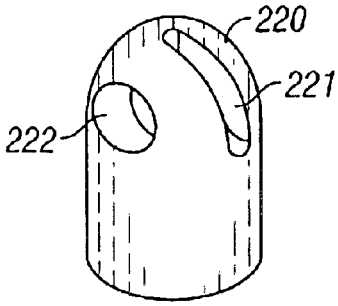
FIG. 12 is a perspective view of a pivoting bracket of the invention.

FIG. 12 depicts pivoting bracket 220. Guard rod 198 preferably includes an angled portion (not shown) adjacent end 202, as shown in FIG. 8. The angled portion may be conveniently threaded through a slot 221 formed by pivoting bracket 220 and inserted into bore 222 as shown in FIG. 12. Alternatively, end 202 may include screw threads (not shown) and be threaded into an axle (not shown) that is inserted into bore 222. Other rotatable mounting attachments can be used successively with or in place of pivoting bracket 220 in the invention including, for example, a ball and socket joint, a universal joint, a flexible cable and a length of chain.

To prepare tool 100 for operation, body 120 is filled with mastic through the filler tube (not shown) and the filler check valve (not shown). The operator may then rotate wheels 10 to move a piston (not shown) in body 120 to force out any air pockets in the mastic.

Next, the operator places a roll of tape 6 onto spool 196 and snaps guard rod 198 into its closed position. Moving sleeve 140 forward on body 120 advances a tab of tape 6 onto the rims of wheels 10. Sleeve 140 can be reciprocated between the feeding position and the neutral position two or three times, if necessary, to achieve sufficient contact between tape 6 and the rims of wheels 10. Each time the slide 140 is moved forwardly, a pin (not shown) or other device mounted on rod 230 catches on the underside of tape 6 and moves it forward. As sleeve 140 is returned to the neutral position, there is little or no tendency for tape 6 to be retracted.

Tool 100 is now ready for use. In order to apply tape 6 and the layer of mastic to a wall surface so as to cover a wallboard joint, the operator moves wheels 10 along the wall causing them to straddle the joint (not shown). Wheels 10 turn as they travel along the wall, applying tape 6 and mastic to the wall surface. Simultaneously, the rotation of wheels 10 causes the piston (not shown) inside body 120 to move forward so as to force mastic onto tape 6. However, when the piston inside body 120 reaches an internal stop (not shown) located near the forward end 123 of body 120, drive wheels 10 become disconnected from the piston and the piston ceases its forward movement. Upon coming to the end of the joint, the operator moves sleeve 140 rearwardly on body 120 so as to cause the knife (not shown) to cut tape 6.

Any time the operator wishes to apply tape 6 and mastic layer to an inner corner of a room, tape creasing disc 9 can be brought into operative position by actuating trigger 70. When the creasing operation is finished, the operator releases trigger 70 and a torsional spring (not shown) returns disc 9 to an inoperative position.

For cleaning or repair, spool mount assembly 190 can be mounted on and removed from body 120 as a one-piece unit. All of the components of spool mount assembly 190 are attached directly or indirectly to base 192, which is the only one of the components that is directly attached to body 120.

Base 192 can be aligned with and secured to body 120 within just a few seconds. The only alignment required is that spool mount assembly 190 be aligned rotationally with wheels 10 of tool 100. Then, tightening one screw 217 on each of the two clamps 218 secures spool mount assembly 190 to body 120.

Each of the two clamps 218 wraps around body 120, hingedly attaches directly to base 192, and is held closed by a single screw 217. This greatly speeds servicing of sleeve 140. Cable changes are also simplified in that end protector 204, which is now part of spool mount assembly 190, detaches from base 192 without the use of any tools. After lifting metal locking tab 206, end protector 204 can be twisted, and removed from base 192. There are no small screws to lose when removing or replacing end protector 206.

Changing rolls of paper tape 6 is also faster and easier than with previously known taper tools. The roll retainer is a wireform rod 198, that is rotatably secured to tool 100 so that it will not be lost. Rod 198 can be unsnapped from detent 210 and rotated up and out of the way to permit access for the roll change. When the new roll is in position on spindle 194, rod 198 is snapped back into place and held by detent 210.

Embodiments of the invention have been described above to better communicate the invention. The scope of the invention, not being limited to the described embodiments, is set forth in the appended claims.

That which is claimed is:

1. A taper tool for feeding tape, the tool comprising:

an elongated body;

a tape feeder mounted on the body;

a spool mounting assembly removably mounted on the body, the spool mounting assembly including a base and a spindle, a tape spool, and a guard rod all mounted on said base so that the spool mounting assembly can be removed as a unit from the body;

a sleeve movable on the body to a position for actuating the tape feeder;

a flange including a recess, the flange movably mounted on the sleeve; and a bearing mounted within the recess to cooperate with the body for moving the sleeve.

2. The tool of claim 1 in which the body has a rearward end and the spool mounting assembly includes an end protector that mounts on the base and is moveable from an unlocked position for removing the end protector from the base to a locked position for retaining the end protector on the spool mounting base.

3. The tool of claim 2 in which the spool mounting assembly includes a locking clip, attachable to the end protector to prevent the end protector from moving with respect to the base.

4. The tool of claim 3 in which the locking clip is releasable by finger pressure and the end protector is removable by hand from the spool mounting assembly.

5. The tool of claim 1 in which the body has a rearward end and the spool mounting assembly includes an end protector that mounts on the base, the end protector extends rearwardly of the rearward body end for protecting the body during use, and the exterior edges of the end protector are rounded to provide a comfortable grip for the user.

6. The tool of claim 1 in which the spool mounting assembly includes a detent for holding the guard rod in the closed position and a stop for mechanically supporting the guard rod in the closed position.

7. The tool of claim 1 in which the guard rod is rotatable between an open position for removing the spool from the spindle and a closed position for retaining the spool on the spindle.

8. The tool of claim 1 which includes means for creasing the tape, and in which the spool mounting assembly includes a trigger for actuating the means for creasing.

9. The tool of claim 1 which includes a clamp for removably mounting the spool mounting assembly on the body.

10. The tool of claim 1 in which the flange is suitably shaped to provide a surface for the user's hand to push or pull against when moving the sleeve to or from the feeding position.

11. The tool of claim 1 in which the flange has an outer surface that provides a comfortable grip for the user.

12. The tool of claim 1 in which the bearing is mounted entirely below the outer surface of the flange.

13. The tool of claim 1 in which the bearing includes an axle removably attached to the flange and a roller that is rotatable about the axle.

14. The tool of claim 1 which includes means for cutting tape operatively connected to the sleeve so that when the sleeve is moved to the cutting position the tape is cut.

15. The tool of claim 1 which includes means for holding mastic and means for delivering mastic to the tape.

16. A taper tool for feeding tape, the tool comprising:

an elongated body;

a tape feeder mounted on the body;

a sleeve movable on the body to a feeding position for actuating the tape feeder;

a flange including a recess, the flange having an outer surface and movably mounted on the sleeve; and a bearing mounted within the recess and entirely below the outer surface, the bearing cooperating with the body for moving the sleeve.

17. The tool of claim 16 in which the flange is suitably shaped to provide a surface for the user's hand to push or pull against when moving the sleeve to or from the feeding position.

18. The tool of claim 16 in which the bearing includes an axle removably attached to the flange and a roller that is rotatable about the axle.

19. The tool of claim 18 in which the flange includes pockets communicating with the recess, and the ends of the axle are inserted into the pockets and retained by a spring-loaded retainer that engages the flange in a retaining position.

20. The tool of claim 19 in which the retainer includes tabs that engage the flange and position the retainer in either of two positions.

21. The tool of claim 16 in which the flange includes an attachment device for attaching a lanyard to the flange.

22. The tool of claim 16, which includes means for cutting tape operatively connected to the sleeve so that when the sleeve is moved to the cutting position the tape is cut.

23. The tool of claim 16, which includes means for holding mastic and means for delivering mastic to the tape.

24. The tool of claim 16 in which the body has a rearward end and the tool includes a spool mounting assembly mounted on the body;

and an end protector removably mounted on the spool mounting assembly extending rearwardly of the rearward end.

25. A taper tool for feeding tape, the tool comprising:

an elongated body;

a tape feeder mounted on the body;

a sleeve having a forward end and a rearward end, the sleeve being movable on the body to a feeding position for actuating the tape feeder;

a front flange including a recess, the front flange having an outer surface and movably mounted on the sleeve;

a rear flange including a recess, the rear flange having an outer surface and movably mounted on the sleeve;

a rear bearing mounted within the rear flange and entirely below the outer surface, the rear bearing cooperating with the body for moving the sleeve; and a front bearing mounted within the front flange and entirely below the outer surface, the front bearing cooperating with the body for moving the sleeve.

26. The tool of claim 25 in which the front flange and the rear flange are suitably shaped to provide, respectively, surfaces for the user's hand to push or pull against when moving the sleeve to or from the feeding position.

27. The tool of claim 25 in which the front flange and the rear flange have rounded exterior edges to provide a comfortable grip for the user.

28. The tool of claim 25 in which each of the bearings includes an axle removably attached to one of the flanges and a roller that is rotatable about the axle.

29. The tool of claim 28 in which each of the flanges includes pockets communicating with the recesses, the ends of each of the axles are in the pockets, and each of the axles is retained by a spring-loaded retainer.

30. The tool of claim 29 in which each of the retainers includes tabs that engage one of the flanges in a servicing position so that the respective axle may be removed from the respective flange and replaced with another axle.

31. The tool of claim 30 in which one of the flanges includes an attachment device for attaching a lanyard to the flange.

32. The tool of claim 25 in which each of the front flange and the rear flange includes a clamping member and a tensioning device for removably mounting the front and rear flanges, respectively.

33. The tool of claim 25 in which the body has a rearward end and the tool includes a spool mounting assembly mounted on the body;

and an end protector removably mounted on the spool mounting assembly extending base and extends rearwardly of the rearward end.

* * * * *